US012285096B2

(12) United States Patent
Agrawal et al.

(10) Patent No.: US 12,285,096 B2
(45) **Date of Patent: *Apr. 29, 2025**

(54) METHOD OF PREVENTING LEAKAGE IN PERSONAL HYGIENE MATERIAL CONTAINERS

(71) Applicant: Paper Tube, LLC, Long Grove, IL (US)

(72) Inventors: Parag Agrawal, Buffalo Grove, IL (US); Vadim Molo, Wheeling, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/228,860

(22) Filed: Apr. 13, 2021

(65) Prior Publication Data

US 2022/0322811 A1 Oct. 13, 2022

(51) Int. Cl.
*A45D 40/02* (2006.01)
*A45D 40/00* (2006.01)

(52) U.S. Cl.
CPC ..... *A45D 40/02* (2013.01); *A45D 2040/0025* (2013.01); *A45D 2200/05* (2013.01)

(58) Field of Classification Search
CPC ..... A45D 40/02; A45D 2040/0025; A45D 2200/05; A45C 11/008; A45C 2011/007
See application file for complete search history.

(56) References Cited

U.S. PATENT DOCUMENTS

| | | | | |
|---|---|---|---|---|
| 1,969,331 | A | 8/1934 | Small | |
| 2,368,045 | A * | 1/1945 | Jensen | A45D 40/02 401/82 |
| 3,070,224 | A | 12/1962 | Robinson et al. | |
| 3,595,449 | A | 7/1971 | Stump et al. | |
| 4,139,311 | A | 2/1979 | Lorscheidt | |
| 5,167,462 | A | 12/1992 | Lucas | |
| 5,833,382 | A | 11/1998 | Jenks et al. | |
| 2021/0259390 | A1* | 8/2021 | Shen | A45D 40/02 |
| 2022/0142333 | A1* | 5/2022 | Shugar | A45D 40/02 |
| 2022/0240646 | A1* | 8/2022 | Hammond | A45D 40/02 |

FOREIGN PATENT DOCUMENTS

| | | | | |
|---|---|---|---|---|
| WO | WO2022003374 | * | 1/2022 | A45D 40/02 |

* cited by examiner

*Primary Examiner* — Bob Zadeh

(57) ABSTRACT

A method for making and assembling personal hygiene material containers whereby a cap and core are provided; a lid is disposed at the cap; the cap is then placed with the lid onto the core; situating a leakage prevention insert within the core; and situating a hygiene material elevator within the core. The leakage prevention insert possesses a circumference greater than that of the core such that upon insertion of the leakage prevention insert into the core an overhang is created along the entirety of the leakage prevention insert's circumference, where the overhang creates a complete and tight seal by creating an abutment with the inner wall of the core. The abutment thereby prevents the leakage of hygiene material during the manufacture fill process when the hygiene material is in its liquid form.

17 Claims, 5 Drawing Sheets

METHOD OF PREVENTING LEAKAGE IN PERSONAL HYGIENE MATERIAL CONTAINERS

This is a nonprovisional patent application under 35 U.S.C. § 111(a).

TECHNICAL FIELD

This disclosure relates generally to the manufacture of personal hygiene material containers and relates more particularly to the prevention of leakage of hygiene material when injected, poured, decanted, or inserted into a personal hygiene material container during the manufacture fill process.

BACKGROUND

Personal hygiene material containers are utilized for a host of applications. Personal hygiene material containers house different types of personal hygiene materials, which when engaged with by a user, are typically applied to the body in some fashion. These containers come in a wide range of shapes and sizes, and moreover, employ multiple types of extraction, extrusion, and application by the containers' users given a specific goal. What remains the same, however, in all varieties, is the necessity to find, build, and maintain efficiencies across the entirety of the manufacture process.

The instant device achieves this goal through the use of a novel approach to the prevention of leaks during the manufacture fill process. The instant device employs a leakage prevention insert, absent in the pertinent prior art—which typically only employs a mechanism for extrusion of the hygiene material in the absence of a seal—which, when inserted into the body of the device, creates an overhang along the entirety of its circumference. This overhang directly abuts the interior wall of the device, thus creating a tight and complete seal. Therefore, during the manufacture fill process, when the hygiene material is injected, poured, or decanted into the body of the device in its liquid form, the leakage prevention insert not only prevents leakage of the hygiene material, but also maximizes retention of the device itself, saving precious resources from scrappage and the delays associated with manufacturing inefficiencies.

BRIEF DESCRIPTION OF THE DRAWINGS

The following detailed description of certain embodiments and best mode will be set forth with reference to the accompanying drawings, in which.

DETAILED DESCRIPTION

Apparatus

Figure 4:
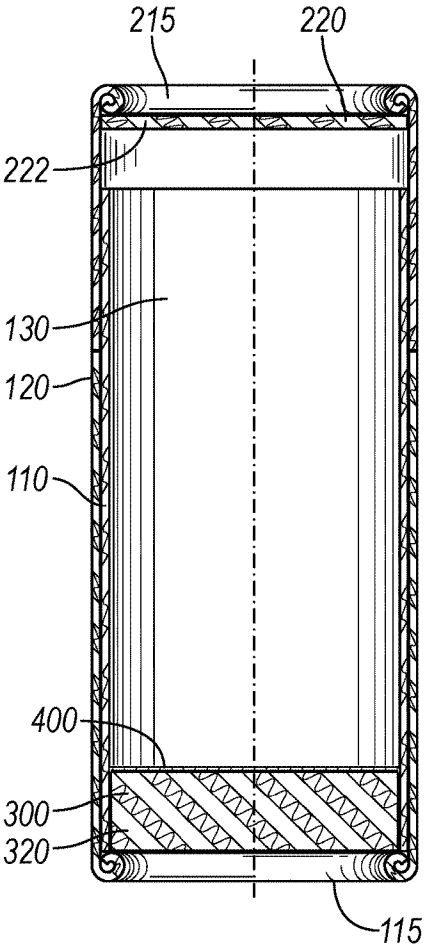
FIG. 4 is a cross-sectional view of an embodiment of the device in which each component's relative location is illustrated, the cross-sectional view taken at arrowed line 4-4 in FIG. 3.

As depicted in FIG. 4, an embodiment of a personal hygiene material container 10 is comprised of a core or body 100. The core 100 is comprised from at least two parts: an inner core 110 and an outer core 120.

Figure 7:
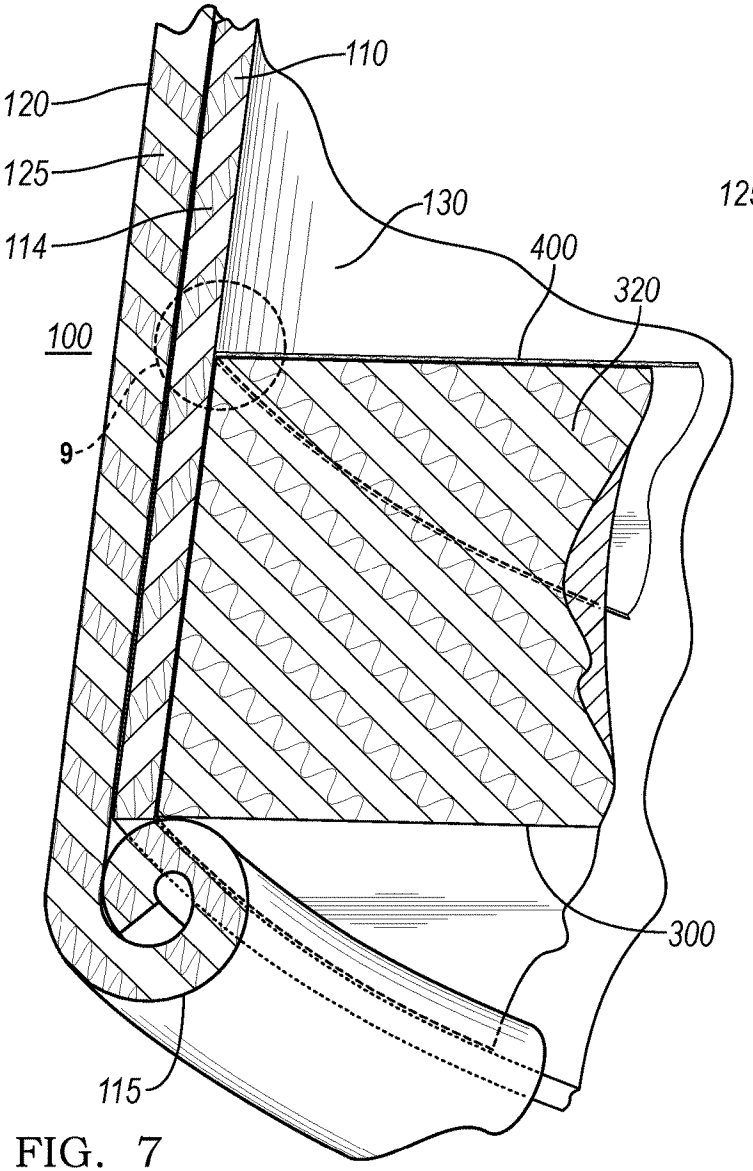
FIG. 7 is an enlarged sectional view of the rolled and wrapped portion of the base of the device.

As depicted in FIG. 7, the inner core 110 is comprised of at least a first plurality of layers 114. The inner core 110 has a first circumference and a second circumference, where a second circumference is greater than that of a first circumference.

Again as shown in FIG. 7, the outer core 120 is comprised of at least a second plurality of layers 125, where a second plurality of layers 125 is different from a first plurality of layers 114. The outer core 120 has a third circumference and a fourth circumference, where the fourth circumference is greater than that of the third circumference, and where the third circumference is greater than the second circumference but can be within manufacturing tolerances of a second circumference of the inner core 110.

Figure 6:
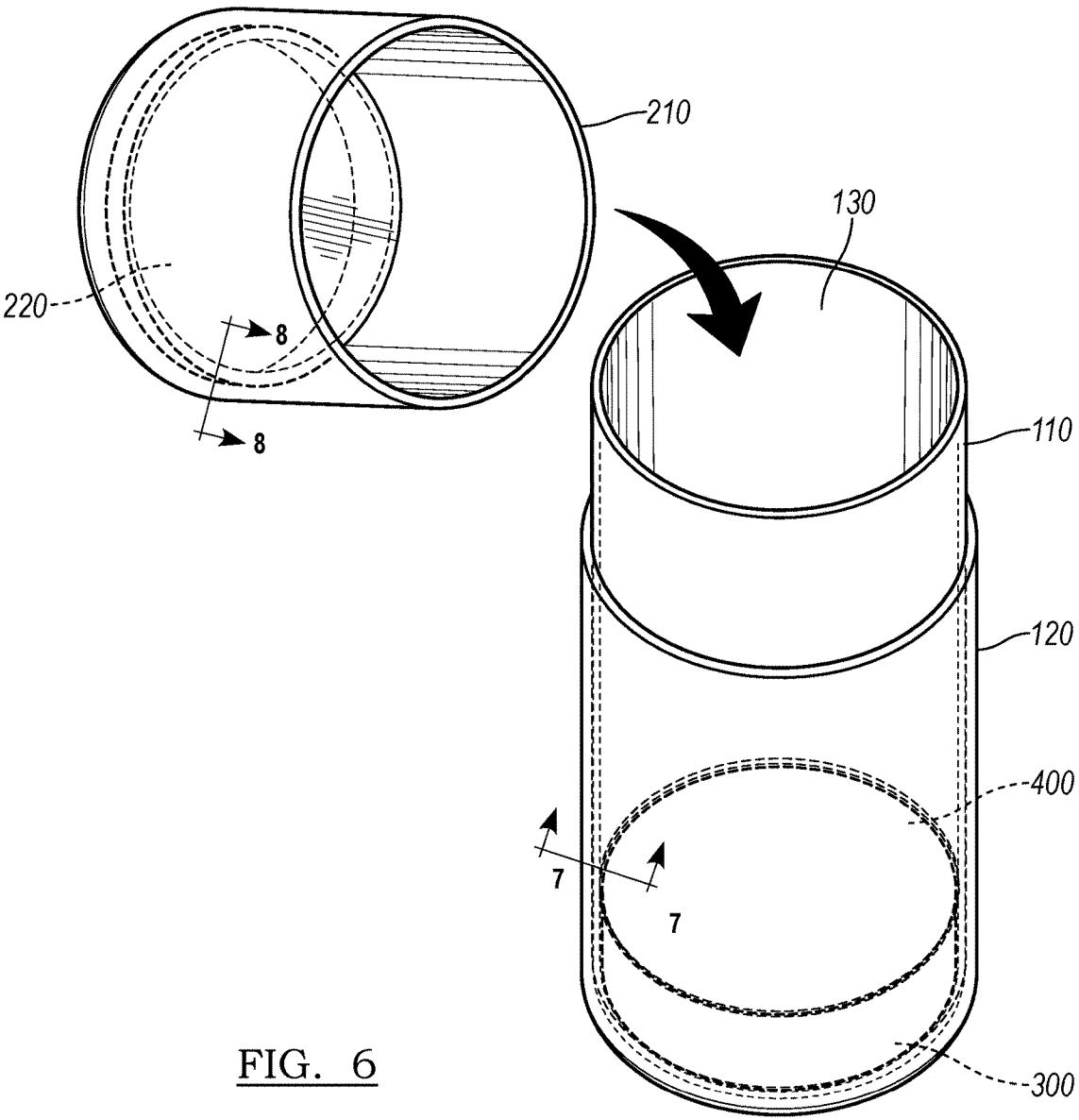
FIG. 6 is an exploded view of an embodiment of the device in which the device's usage is illustrated.

Moreover, as depicted in FIG. 6, the personal hygiene material container 10 is further subdivided into at least two components: a body 100 and a cap 200. The body 100 is the portion of the personal hygiene material container 10 into which the hygiene material is housed. The body 100 is further comprised of at least two components: an interior portion and an exterior portion. Moreover, the interior portion of the body 100 is comprised of the inner core 110 and the exterior portion of the body 100 is comprised of the outer core 120. Both the interior and exterior portions of the body 100 are combined during the construction and assembly process 500.

As shown in FIG. 6, the interior portion of the body 100 has a first extent. The exterior portion of the body 100 has a second extent, where the second extent is less than the first extent. The second extent of the exterior portion of the body 100 has a first terminal edge and a second terminal edge. The interior portion of the body 100 has a third terminal edge and a fourth terminal edge, where the third terminal edge and the fourth terminal edge are different from the first terminal edge and second terminal edge. The first terminal edge of the exterior portion of the body 100 is rolled and wrapped around the third terminal edge of the interior portion of the body 100. The rolled and wrapped portion 215 of the first terminal edge of the outer core 120 of the body 100 is affixed in place by a combination of press-fit immobilization and the use of an adherent. The first terminal edge of the exterior portion of the body 100 interacts with the third terminal edge of the interior portion of the body 100, the inner wall of the inner core 110, and the leakage prevention insert 400 to create a tight seal to prevent leakage of the personal hygiene material during the manufacturing fill process. The interaction of the rolled and wrapped portion 215 of the first terminal edge and the third terminal edge also creates a delimiting point at which the hygiene material leakage prevention insert 400 and the hygiene material elevator 300 can be inserted into the body 100. Shown in FIG. 6, the second terminal edge of the outer portion of the body 100 acts as the delimiting point to which the cap 200 can completely and securely enclose the personal hygiene material container 10.

Shown in FIG. 7, the personal hygiene material container 10 possesses a hygiene material elevator 300. In the embodiment depicted, the hygiene material elevator 300 is comprised of at least a third plurality of layers 320, where the third plurality of layers 320 of the hygiene material elevator 300 is different from the first plurality of layers 114 of the inner core 110, as well as the second plurality of layers 125 of the outer core 120. Additionally in the embodiment depicted, the third plurality of layers 320 of the hygiene material elevator 300 are in the form of circular discs after being inserted into a die-cut machine. The plurality of discs of the hygiene material elevator 300 have a fifth circumference that is less than that of the first circumference of the inner core 110. Moreover, the hygiene material elevator 300 interacts with the rolled and wrapped portion 115 of the outer core's 120 terminal edge, creating a limiting point of insertion for the hygiene material elevator 300. Additionally, the hygiene material elevator 300 allows a user of the device, when pushing or pressing on an exposed side of the leakage prevention insert 400, to elevate the hygiene material up and through the body 100, and ultimately extrude it from the open end of the interior portion of the body 100, thus allowing the user to apply the hygiene material to oneself.

Figure 9:
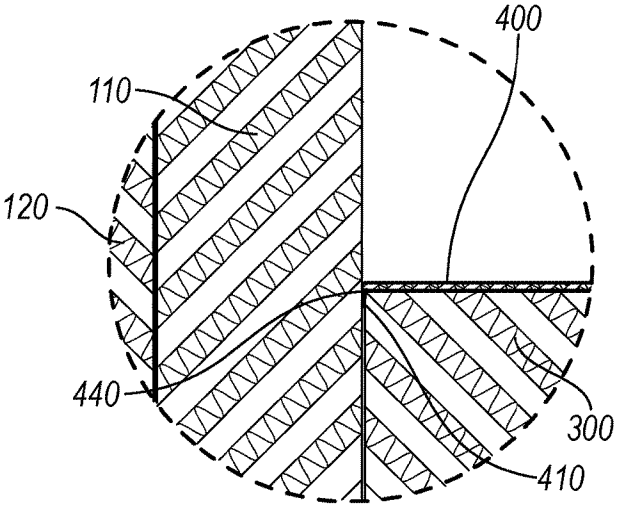
FIG. 9 is an enlarged sectional view of the leakage prevention insert, the leakage prevention insert's overhang, and the abutment between the overhang and the interior wall of the body of the device.

Moreover, as shown in FIGS. 7 and 9, the personal hygiene material container 10 is additionally comprised of a leakage prevention insert 400. In the embodiment depicted, the leakage prevention insert 400 is in the form of a circular disc, where additionally, in the same embodiment, the leakage prevention insert 400 is comprised of at least one layer. The leakage prevention insert 400 has a sixth circumference that is greater than both the first circumference of the inner core 110 and the fifth circumference of the hygiene material elevator 300 but less than the second circumference of the inner core 110. The leakage prevention insert 400 abuts on a first side the hygiene material elevator 300 and on a second side the hygiene material housed within the interior portion of the body 100.

As depicted in FIG. 9, the leakage prevention insert 400 interacts with the interior surface of the inner core 110. Because the sixth circumference is greater than the first circumference of the inner core 110, an overhang 410 is produced along the entirety of the sixth circumference when the leakage prevention insert 400 is pressed into the interior portion of the body 100. In the embodiment depicted, the overhang 410 forms a right angle relative to the plane of the leakage prevention insert 400 and is parallel to the interior wall of the body 100. The combination of the direct abutment 420 of the overhang 410 of the sixth circumference in addition to the interaction of the hygiene material elevator 400 and the rolled and wrapped portion 115 of the outer core 120 results in a tight, secure seal of the personal hygiene material container 10. This interaction ensures a de minimis level of leakage of hygiene material in its liquid form when it is injected, filled, poured, or decanted into the personal hygiene material container 10 during the manufacturing fill process 500.

Figure 2:
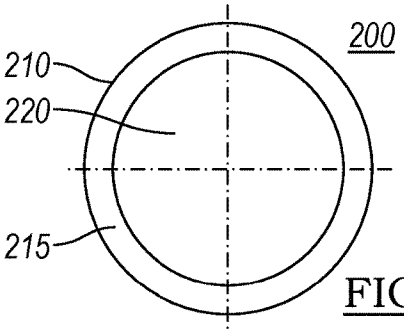
FIG. 2 is a top view of an embodiment of the device.
Figure 3:
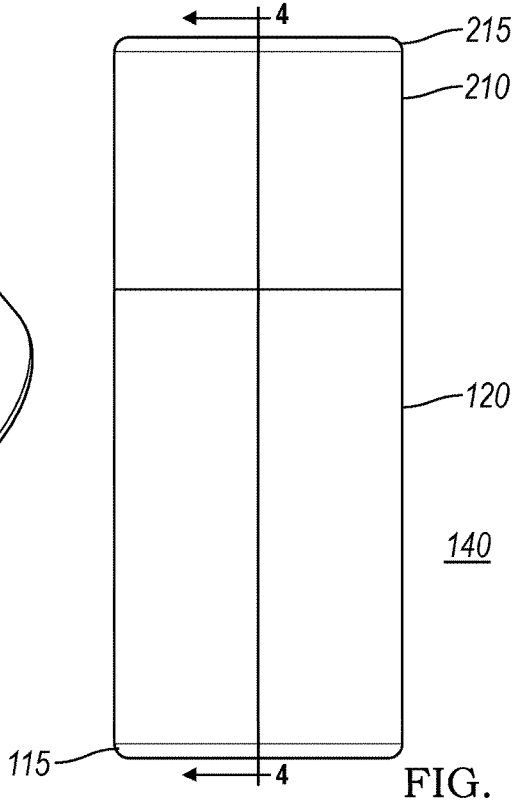
FIG. 3 is a side view of an embodiment of the device.
Figure 8:
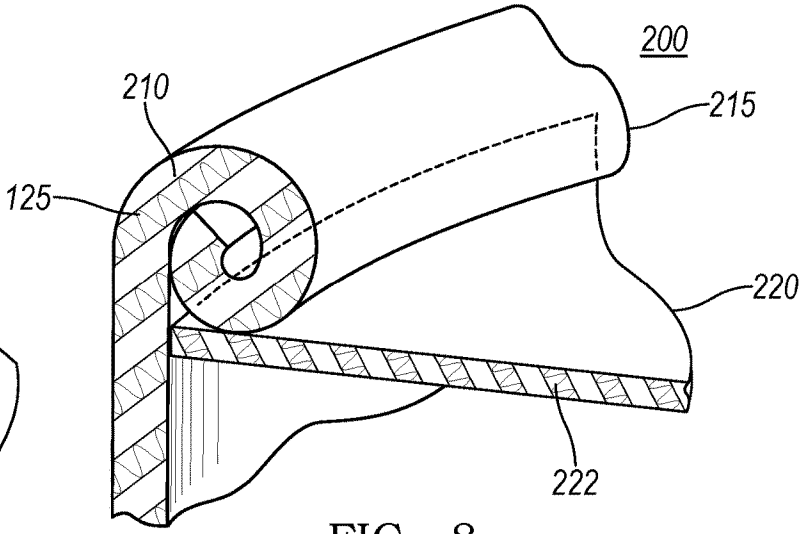
FIG. 8 is an enlarged section view of the rolled and wrapped portion of the cap of the device.

As shown in FIGS. 2, 6, and 8, the personal hygiene material container 10 is further comprised of a cap 200. The cap 200 is further comprised of a wall. The wall of the cap 200 is comprised of the outer core 210 of the personal hygiene material container 10. The cap 200 is further comprised of a lid 220. The lid 220 is comprised of a fourth plurality of layers 222, where the fourth plurality of layers is different from the first, a second, and a third plurality of layers 114, 125, 320. In the embodiment depicted, the lid 220 of the cap 200 is in the form of a disc, where the disc of the lid 220 is different from the disc of the hygiene material elevator 300 and the disc of the leakage prevention insert 400. The lid 220 of the cap 200 has a seventh circumference, where a seventh circumference is less than the third circumference of the outer core 120. The lid 220 is situated perpendicular to the wall of the cap 200. Moreover, the lid 220 is affixed in place by a combination of press-fit immobilization and the use of an adherent, where the adherent is applied to the exposed edge of the bound and combined fourth plurality of layers 222 of the lid 220. The lid 220 is further immobilized by an abutment between the exposed surface of the lid 220 and the rolled and wrapped edge 215 of the sixth terminal edge of the cap 200. The lid 220 interacts with the rolled and wrapped portion 215 of the sixth terminal edge in a manner such that the interaction securely encloses one end of the cap 200.

Figure 1:
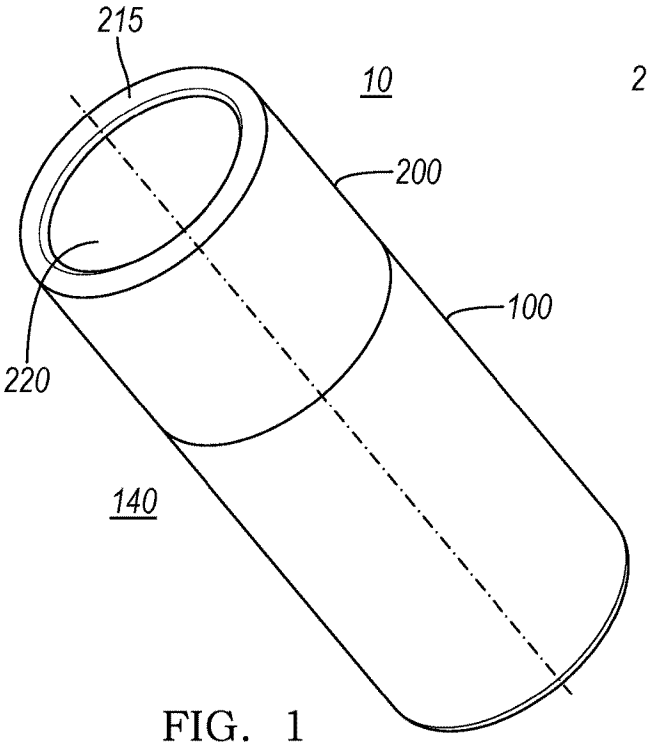
FIG. 1 is perspective view of an embodiment of the device.

Additionally, as shown in FIGS. 1, 2, and 6, the wall of the cap 200 has a third extent, where the third extent is different from the first and second extents. The wall of the cap 200 has a fifth terminal edge and a sixth terminal edge, where the fifth and sixth terminal edges are different from the first, second, third, and fourth terminal edges. The sixth terminal edge of the cap 200 is rolled and wrapped around onto the inner surface of the wall of the cap 200. The rolled and wrapped portion 215 of the sixth terminal edge is affixed in place by a combination of press-fit immobilization and the use of an adherent.

Method of Construction and Assembly

Figure 10:
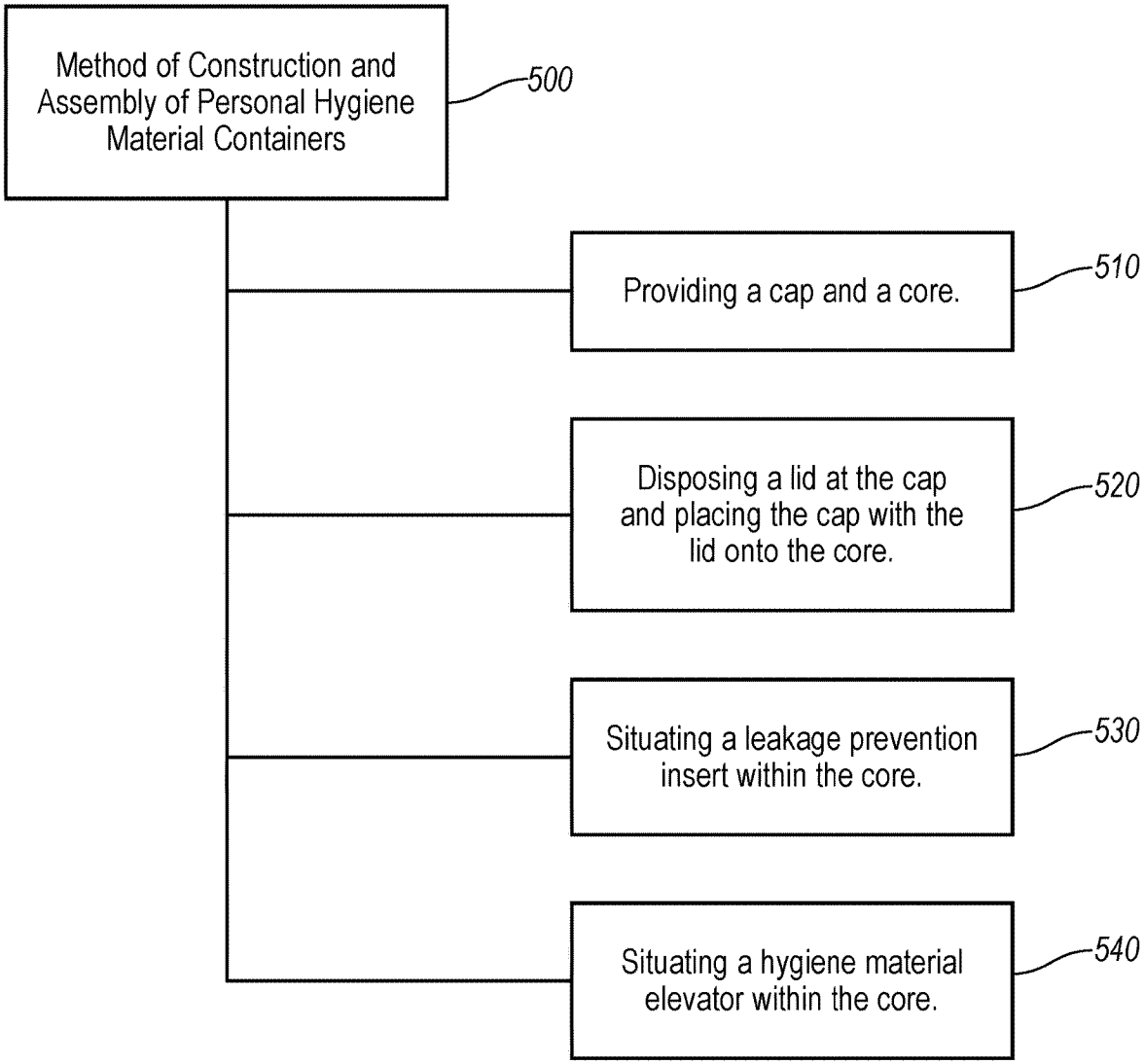
FIG. 10 is a flowchart which outlines the general method of construction and assembly of the personal hygiene material container.

As shown in FIG. 10, the general method of the construction and assembly of the personal hygiene material container 10, 500 is outlined. The general process describes providing a cap 200 and a core 100, 510, disposing a lid 220 at the cap 200 and placing a cap 200 with the lid 220 onto the core 520, situating a leakage prevention insert 400 within the core 530, and situating a hygiene material elevator 300 within the core 540.

The components of the personal hygiene material container 10 are constructed in any particular instance according to each manufacturer's specific requirements with respect to the parameters of all of the components listed herein. In at least one nonlimiting example, both the inner core 110 and outer core 120 are produced by spiral core winding equipment. For this equipment, the tooling within the machine is set such that it matches the desired maximum diameter for the inner core 110 of the personal hygiene material container 10.

Referring primarily to FIG. 10 for the method of construction and assembly, prior to the assembly of the inner and outer cores 110, 120, a source material, such as, but not limited to, large, pre-cut paper spools is passed through a station or machine in which each layer of source material is coated with an adhesive. In the embodiment depicted, the inner and outer cores 110, 120 are comprised of at least three layers of source material. In addition to the layers of the source material, the inner core 110 is further comprised of an inner lining 130. A chemical or mixture of chemicals is applied to the inner lining 130 by yet another machine or station. The chemical or mixture of chemicals applied to the inner lining 130 prevent adhesion between the inner wall of the inner core 110 and the personal hygiene material both in its liquid and solid states. Additionally, the inner lining 130 is comprised of either the same source material or another material that exhibits properties similar to that of the source material such that it can be fed into a spiral core winding machine; accept and assume a rigid, cylindrically wrapped form; and effectively bond with an adhesive.

Once the inner lining 130 is adequately coated with the chemical or chemical mixture and the layers of source material are covered in the adhesive, both the inner lining 130 and the source material are fed into the spiral core winding machine. The spiral core winding machine then combines, per manufacturer specifications, any number of layers of source material together. During this process, the inner lining 130 is fed into the spiral core winding machine first, followed subsequently by a plurality of layers of source material. The spiral core winding machine rolls a continuous, rigid, spiral core. The continuous, rigid, spiral core is cut by a cutting machine at predefined lengths based on the manufacturer's specifications.

This set of steps of the method of making; coating source material with adhesive, feeding it into the spiral core winding machine, rolling a continuous core, and cutting the core at predetermined lengths; is performed twice: a first time for the inner core 110 and a second time for the inner core 120, where the lengths of the predetermined cuts are relative to the manufacturer's requirements for the inner and inner core 120, respectively. Once both the inner and outer cores 110, 120 have been made, they are adhered and pressed together, where the inner core 110 is placed within the inner core 120. This step of layering the cores yields a single, rigid, cylindrically wrapped, combined core. The maximum outer diameter of the combined core is determined by the manufacturer's specifications for the total number of layers of source material desired, inclusive of the inner lining 130.

An additional step in the method of making a personal hygiene material container 10 is the providing and assembly of the cap 200. The cap 200 is made by a spiral core winding machine.

In the instance of the cap 200, the wall of the cap 200 is comprised of the inner core 120. In line with the manufacturer's requirements, layers of source material are fed to a station or machine which coats them with adhesive. The layers of source material are fed into the spiral core winding machine, rolled into a continuous, cylindrically wrapped, rigid core, and then cut by a cutting machine at predetermined lengths.

An additional step in the method of making a personal hygiene material container 10 is the making and assembly of the lid 220 of the cap 200. The lid 220 of the cap 200, in the embodiment depicted, is in the form of a circular disc. The disc is comprised of the same source material as that of the inner and outer cores 110, 120. Again, per the manufacturer's requirements, the lid 220 is comprised of the a plurality of layers of source material. Each layer is again fed to a station or machine that coats it in adhesive. The source material for the lid 220 is then fed into a machine which combines the layers of the adhesive covered source material together through the use or combination of force, heat, or some other process such that the layers permanently bind together. The combined layers of source material are then fed into a die-cutting machine where the individual lids 220 are cut out. The newly cut lids 220 are then fed into another station or machine where their edges, having a thickness, are coated with adhesive. Once the edges are coated in adhesive, they are fed into another machine where they are pressed into the interior space of the cap 200 to a predetermined extent. Because the circumference of the lid 220 is greater than that of the inner core 110 yet less than that of the inner core 120, the lid 220 is affixed in place both by press-fit immobilization and the use of an adhesive. Additionally, the outer surface of the lid 220 directly abuts the rolled and wrapped portion of the terminal edge of the wall of cap 200, additionally immobilizing the lid 220 and securely enclosing one end of the cap 200.

An additional step in the method of making of the personal hygiene material container 10 is the making and assembly of the hygiene material elevator. The hygiene material elevator 300, in the embodiment depicted, is in the form of a circular disc, where the circular disc has a plurality of layers. The hygiene material elevator 300 is comprised of the same source material as that of the inner and outer cores 110, 120. The layers of the hygiene material elevator 300 which directly abut the personal hygiene material is first coated with the chemical or mixture of chemicals of the inner lining 130 of the inner core 110 mentioned herein, such that the chemical or mixture of chemicals prevents adhesion between the surface of the hygiene material elevator 300 and the personal hygiene material itself, both in its liquid and solid states. Next, each layer of the hygiene material elevator 300 is fed to a station or machine that coats it in adhesive. The adhesive covered layers of the hygiene material elevator 300 are combined through the use or combination of force, heat, or some other process such that the layers permanently bind together. The combined layers of source material are then fed into a die-cutting machine where each individual hygiene material elevator 300 is cut out. Once cut out, the hygiene material elevators 300 are fed into another machine where they are pressed into the interior space of the inner core 110 of the body 100 up to a predetermined extent, where one side of the hygiene material elevator 300 directly abuts the leakage prevention insert 400 and the chemical coated side abuts the hygiene material.

An additional step in the method of making of the personal hygiene material container 10 is the making and assembly of the leakage prevention insert 400. The leakage prevention insert 400, in the embodiment depicted, is in the form of a circular disc, where the circular disc is comprised of at least one layer. The leakage prevention insert 400 is comprised of the same source material as that of the inner and outer cores 110, 120. Next, each layer of the leakage prevention insert 400, if comprised of multiple layers, is fed to a station or machine that coats it in adhesive. The source material for the leakage prevention insert 400 is then fed into a machine which combines the layers of the adhesive covered source material together through the use or combination of force, heat, or some other process such that the layers permanently bind together. The combined layers of source material are then fed into a die-cutting machine where each individual leakage prevention insert 400 is cut out.

At this step, the leakage prevention insert 400 is cut to a circumference that is greater than a first circumference of the inner core 110. The excess diameter of the leakage prevention insert 400 facilitates an interaction between the leakage prevention insert 400 and the interior wall of the inner core 110. Once cut out, each leakage prevention insert 400 is fed into another machine where it is pressed into the interior space of the inner core 110 of the body 100 up to a predetermined extent. The additional diameter creates an overhang 410, such that a tight seal is formed between the leakage prevention insert 400 and the inner wall of the inner core 110.

Furthermore, the leakage prevention insert 400 further interacts with the rolled and wrapped portion of the terminal edge of the inner core 120, further securely sealing the personal hygiene material container 10. The result of this two-pronged seal is that during the manufacturing fill process, when the hygiene material, in its liquid form, is injected, poured, or decanted into the empty space of the personal hygiene material container 10, a de minimis amount of hygiene material is lost to leakage or spillage. Further due to this two-pronged seal, not only does the manufacturer gain production efficiencies, but because leakage is prevented, the manufacturer also avoids scrappage of source material and containers.

An additional step in the method of construction of the personal hygiene material container 10 is the rolling and wrapping of the terminal edge of the inner core 120. After the inner core 110 and the inner core 120 are combined and adhered together, the terminal edge of the inner core 120 is passed to a station or machine which rolls and wraps the terminal edge of the inner core 120 over the terminal edge of the inner core 110 and into the interior space of the container such that it directly abuts the inner wall of the inner core 110. The rolled and wrapped portion edge of the outer core's 120 terminal edge is immobilized and affixed in place by the combination of press-fit restriction and an adherent.

An additional step in the method of making of the personal hygiene material container 10 is the rolling and wrapping of the terminal edge of the cap 200. After the cap 200 is rolled and cut to size, the terminal edge of the cap 200 is passed to a station or machine which rolls and wraps the terminal edge over and into the interior space of the cap 200 such that it directly abuts the inner wall of the inner cap 200. The rolled and wrapped portion of the cap 200's terminal edge is immobilized and affixed in place by the combination of press-fit restriction and an adherent.

An additional step in the method of making of the personal hygiene material container 10 is the addition of printed labeling and artwork 140 which adorns the device. Per manufacturer specifications, a source material, such as, but not limited to, paper, is fed into a lithography and offset printing machine. Once fed into the lithography printing machine, a printer prints or laminates the source material with the required aesthetic ornamentation 140. Furthermore, the manufacturer may choose to include foil stamping, embossing, debossing, or other customizations which will ultimately adorn the surface of the device. In the event that a manufacturer includes this type of aesthetic adornment, the printed, laminated, embossed, or debossed layer of source material is fed into a cutting machine where it is cut into individual labels relative to the specifications of the size of the body 100 and cap 200 of the device. The side of the printed source material 140 that comes into direct contact with the body 100 and cap 200 of the device is treated with an adhesive. Once the adhesive is applied, the individually cut printed labeling and artwork 140 is fed into another machine which wrap and affix the labeling 140 around the container 10.

Figure 5:
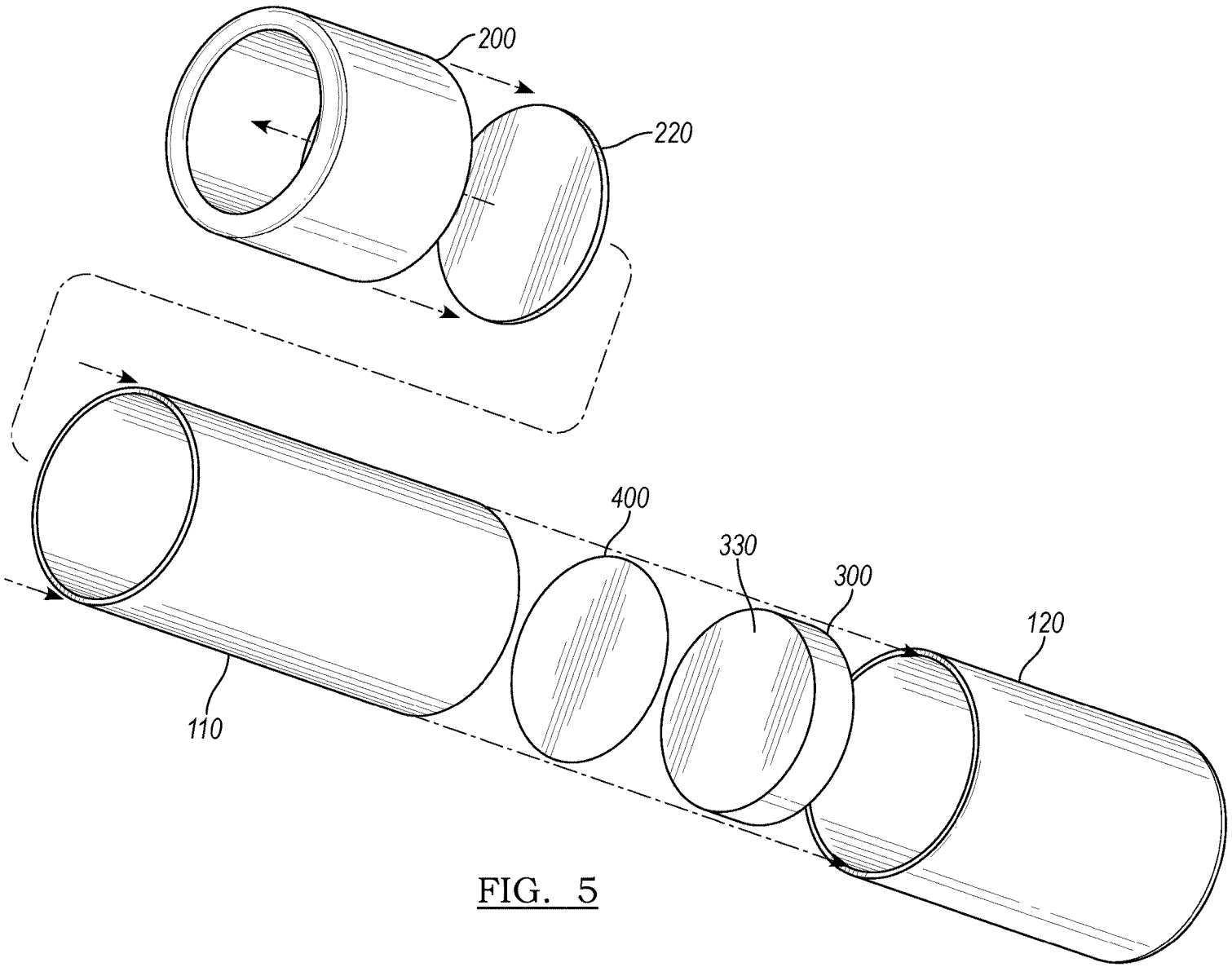
FIG. 5 is an exploded view of an embodiment of the device in which each individual component's relative arrangement within the device is illustrated.

As depicted in FIG. 5, an additional step in the method of making the personal hygiene material container 10 is the final assembly and arrangement of all the components listed herein such that when combined, this combination results in the personal hygiene material container 10.

The forms of the invention herein disclosed constitute presently preferred embodiments and many other forms and embodiments are possible. It is not intended herein to mention all the possible equivalent forms or ramifications of the invention. It is understood that the terms used herein are merely descriptive, rather than limiting, and that various changes may be made without departing from the spirit or scope of the invention.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed:

1. A method of assembling a personal hygiene material container, the method comprising:

providing a core and a cap, said core comprised of an inner core and an outer core, where said inner and outer cores are comprised of a plurality of layers; said cap is comprised of said outer core; and where said core and said cap are composed of a paper material;

disposing a lid at said cap, said lid comprised of a plurality of layers, and placing said cap with said lid onto said core, said lid composed of a paper material;

situating a leakage prevention insert within said core, said leakage prevention insert comprised of a plurality of layers, where said leakage prevention insert establishes a tight seal against the innermost layer of said core; said leakage prevention insert composed of a paper material; and situating a hygiene material elevator within said core and above said leakage prevention insert, said hygiene material elevator comprised of at least one layer, said hygiene material elevator composed of a paper material.

2. The method of assembling a personal hygiene material container of claim 1, further comprising the step of applying an adhesive to said plurality of layers of said inner and outer cores.

3. The method of assembling a personal hygiene material container of claim 2, further comprising the step of inserting said plurality of layers of said outer core into a spiral core wrapping machine wherein said plurality of layers of said outer core are spirally wrapped and bound together.

4. The method of assembling a personal hygiene material container of claim 3, further comprising the step of cutting said inner core and said outer core, wherein said inner core is cut to a first extent and said outer core is cut to a second extent, and wherein said first extent is different than said second extent.

5. The method of assembling a personal hygiene material container of claim 4, further comprising the step of inserting said inner core into said outer core and adhering said inner core to said outer core wherein the combined cores create a single, rigid, spiral-wrapped body.

6. The method of assembling a personal hygiene material container of claim 5, further comprising the step of rolling and wrapping a terminal edge of said outer core in and around a terminal edge of said inner core wherein the said terminal edge of said outer core directly abuts said innermost layer of said inner core; and wherein said rolled and wrapped terminal edge of said outer core is affixed in place by an adherent and press-fit immobilization.

7. The method of assembling a personal hygiene material container of claim 4, further comprising the step of providing said cap and cutting said spirally wrapped outer core to a third extent, wherein said third extent is different from said first extent and said second extent.

8. The method of assembling a personal hygiene material container of claim 7, further comprising the step of rolling and wrapping a terminal end of said cap wherein said terminal end of said cap directly abuts an interior wall of said cap; and wherein said terminal end of said outer core of said cap is affixed in place by an adherent and press-fit immobilization.

9. The method of assembling a personal hygiene material container of claim 1, further comprising the step of applying a chemical or chemical mixture to the surface of said innermost layer of said inner core that directly abuts the hygiene material placed into the personal hygiene material container such that said chemical or chemical mixture prevents adhesion between said innermost layer of said inner core and said hygiene material.

10. The method of assembling a personal hygiene material container of claim 9, further comprising the step of inserting said plurality of layers of said inner core into a spiral core wrapping machine wherein said plurality of layers of said inner core are spirally wrapped and bound together.

11. The method of assembling a personal hygiene material container of claim 1, further comprising the step of applying an adhesive to said at least one layer of said hygiene material elevator, inserting said at least one layer of said hygiene material elevator into a machine in which said at least one layer of said hygiene material elevator are bound together and cut out using a die-press machine.

12. The method of assembling a personal hygiene material container of claim 11, further comprising the step of applying a chemical or chemical mixture to at least one side of said hygiene material elevator, wherein said at least one side of said hygiene material elevator which directly abuts the hygiene material does not adhere to the hygiene material.

13. The method of assembling a personal hygiene material container of claim 1, further comprising the step of applying an adhesive to said plurality of layers of said leakage prevention insert, inserting said plurality of layers of said leakage prevention insert into a machine in which said plurality of layers of said leakage prevention insert are permanently bound together and cut out using a die press machine.

14. The method of assembling a personal hygiene material container of claim 13, further comprising the step of inserting said leakage prevention insert into said inner core; wherein the insertion of said leakage prevention insert into said inner core creates an overhang along the entirety of circumferential edge of said leakage prevention insert; and wherein said overhang creates a complete seal between said leakage prevention insert and said innermost layer of said inner core, thus preventing leakage from said personal hygiene material container during the manufacture fill process.

15. The method of assembling a personal hygiene material container of claim 1, further comprising the step of applying an adhesive to said plurality of layers of said lid, inserting said plurality of layers of said lid into a machine in which they are permanently bound together cut out using a die press machine.

16. The method of assembling a personal hygiene material container of claim 15, further comprising the step of inserting said lid into the interior space of said cap, wherein the insertion of said lid is delimited by said terminal end of said cap and applying an adhesive to a circumferential edge of said lid wherein said lid is affixed in place by press-fit immobilization resulting in the complete enclosure on a single end of said cap.

17. The method of assembling a personal hygiene material container of claim 15, further comprising the step of assembling said inner and outer cores, said hygiene material elevator, said leakage prevention insert, and said cap into said personal hygiene material container.

* * * * *